US008698623B1

(12) United States Patent
Hicks

(10) Patent No.: US 8,698,623 B1
(45) Date of Patent: Apr. 15, 2014

(54) CHILD MONITOR DEVICE

(76) Inventor: Gabrielle E. Hicks, Carmichael, CA (US)

( * ) Notice: Subject to any disclaimer, the term of this patent is extended or adjusted under 35 U.S.C. 154(b) by 242 days.

(21) Appl. No.: 13/278,819

(22) Filed: Oct. 21, 2011

(51) Int. Cl.
*G08B 1/08* (2006.01)

(52) U.S. Cl.
USPC ..... 340/539.15; 340/539.11; 340/539.13; 340/539.1

(58) Field of Classification Search
USPC ..... 340/539.15, 539.11
See application file for complete search history.

(56) References Cited

U.S. PATENT DOCUMENTS 6,078,260 A 6/2000 Desch
6,127,931 A * 10/2000 Mohr ..... 340/573.4
6,278,370 B1 8/2001 Underwood
7,259,671 B2 8/2007 Ganley et al.
8,423,000 B2 * 4/2013 Dhuna ..... 455/414.1
2005/0280546 A1 * 12/2005 Ganley et al. ..... 340/573.4

* cited by examiner

*Primary Examiner* — Kerri McNally

(57) ABSTRACT

The child monitor device provides a caregiver monitor for communication with a plurality of bracelets, each lockable, flexible and softly covered bracelet typically for a child to wear. Bracelet locks are provided as purely mechanical and also in electronic locking. Locks used further include a lock sleeve to cover the lock. Each bracelet includes audio alarm. Each bracelet provides for GPS and a USB port for communication with other devices and even for charging the battery pack. The caregiver monitor provides a touchscreen that further comprises fingerprint recognition so that only those approved in advance by the caregiver monitor are allowed device control. The touchscreen further provides GPS mapping and function controls such as alarm distances between the monitor and the bracelets and alarm controls.

16 Claims, 4 Drawing Sheets

CHILD MONITOR DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The advent of various devices for monitoring a child's whereabouts and distance from a caregiver has been a response to the potential dangers related to child care. Children need a certain amount of freedom that fences and child leashes and handholding cannot give and that monitoring devices might provide. Additionally, many such devices not only provide for locating a child at all times but also have alarms so that exceeding a given distance from a caregiver triggers an audible or visible alarm in the caregiver's companion device. Alarms may also be triggered in a device worn or carried by a child. Most alarms, though, are pre-programmed to a set distance between a child-worn device and a caregiver monitor. The present device provides desirable and programmable features and also includes a fingerprint recognition touch screen for allowing only the programmed caregiver access to multiple child monitoring and to allow for user introduced device settings.

FIELD OF THE INVENTION

The child monitor device relates to child monitoring devices and more especially to a child monitor device that provides multiple child bracelets with audio feedback and a caregiver device with touchscreen, GPS locating, audio and visual information, fingerprint recognition control and caregiver bracelet lock control.

SUMMARY OF THE INVENTION

The general purpose of the child monitor device, described subsequently in greater detail, is to provide a child monitor device which has many novel features that result in an improved child monitor device which is not anticipated, rendered obvious, suggested, or even implied by prior art, either alone or in combination thereof.

To attain this, the child monitor device provides a caregiver monitor with numerous capabilities and functions. The caregiver monitor provides for communication with a plurality of bracelets, each bracelet typically for a child to wear but not limited to such. Communication includes voice communication from the caregiver monitor to each bracelet, each communication separately controlled by the caregiver monitor. The bracelets may be flexible and lockable and may include a soft cover for comfort's sake. Of importance, each bracelet may incorporate an electronic lock that is operable only by the caregiver monitor. This feature provides extreme security for each bracelet. Locks may also be purely mechanical. Any lock used may further include a lock sleeve to cover the lock.

Each bracelet may include audio alarm. Each bracelet provides for GPS and may provide a USB port for communication with other devices and even for charging the battery pack.

Importantly, the caregiver monitor provides a touchscreen that further comprises fingerprint recognition so that only those approved in advance by the caregiver monitor are allowed device control. The touchscreen further provides GPS mapping and function controls for the bracelet GPS and the monitor GPS. Function controls may include setting of approved alarm distances between the caregiver monitor and each bracelet, caregiver recognition, audio and visual alarms, microphone control, speaker control, and bracelet electronic lock.

Thus has been broadly outlined the more important features of the improved child monitor device so that the detailed description thereof that follows may be better understood and in order that the present contribution to the art may be better appreciated.

An object of the child monitor device is to provide for child security.

Another object of the child monitor device is to provide for child security with a caregiver monitor that communicates with child monitor bracelets.

Another object of the child monitor device is to provide for caregiver lock control of the child bracelets.

An object of the child monitor device is to provide flexible child bracelets.

A further object of the child monitor device is to provide audio alerts for both child and caregiver.

An added object of the child monitor device is to provide for visual alerts for the caregiver.

Another object of the child monitor device is to provide for voice communication from the caregiver monitor to each bracelet.

And, an object of the child monitor device is to provide an informational and controlling touchscreen for the caregiver monitor that controls both the monitor and each bracelet individually.

A further object of the child monitor device is to provide for fingerprint recognition within the touchscreen such that only approved caregivers may access device functions.

Another object of the child monitor device is to provide GPS of child location for the caregiver.

Still another object of the child monitor device is to provide for USB port communication.

These together with additional objects, features and advantages of the improved child monitor device will be readily apparent to those of ordinary skill in the art upon reading the following detailed description of presently preferred, but nonetheless illustrative, embodiments of the improved child monitor device when taken in conjunction with the accompanying drawings.

DETAILED DESCRIPTION OF THE DRAWINGS

With reference now to the drawings, and in particular FIGS. 1 through 6 thereof, the principles and concepts of the child monitor device generally designated by the reference number 10 will be described.

Figure 3:
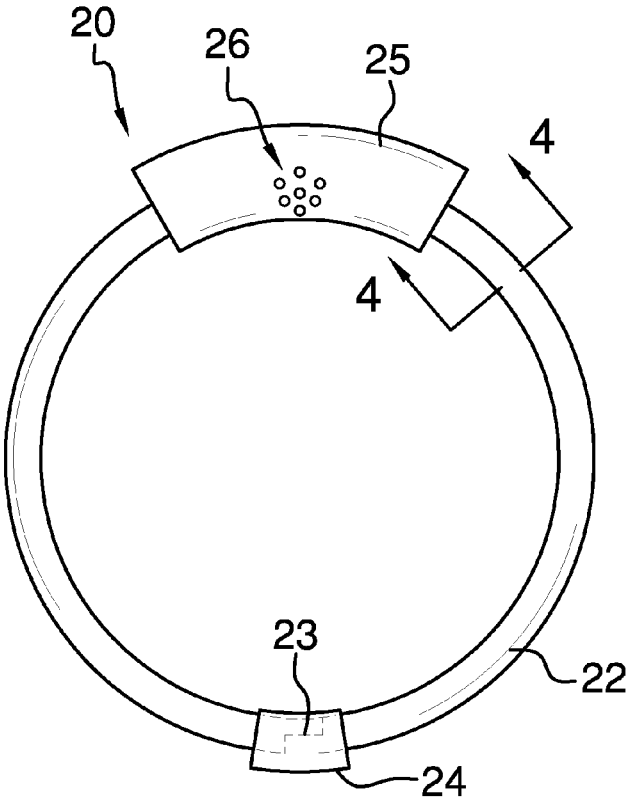
FIG. 3 is a lateral elevation view of the bracelet.

Referring to FIG. 3, the device 10 partially comprises a plurality of flexible bracelets 20, each bracelet 20 like the one illustrated.

Figure 4:
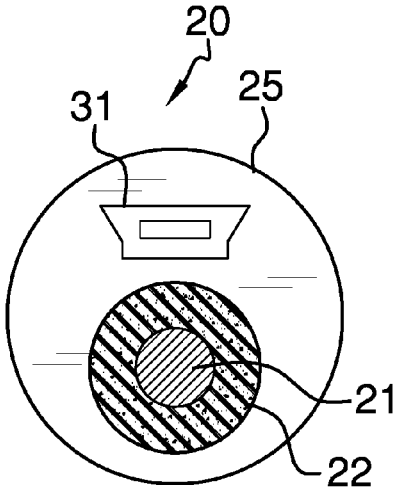
FIG. 4 is a partial cross sectional view of FIG. 3, taken along the line 4-4.
Figure 5:
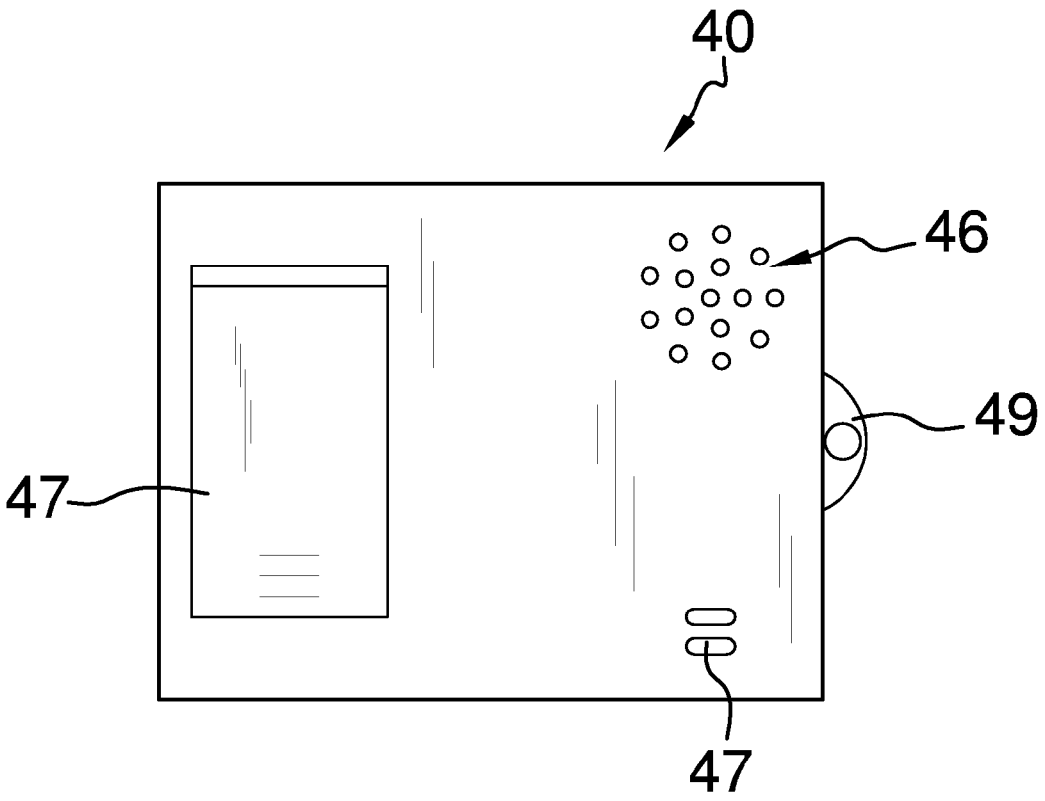
FIG. 5 is a bottom plan view of the caregiver monitor.

Continuing to refer to FIG. 3 and referring also to FIG. 4, each bracelet 20 further comprises a cable 21. A soft cover 22 surrounds the cable 21.

Referring to FIG. 6 and again to FIG. 3, an electronic lock 23 is configured to provide an open ended cable 21 in a first condition and a closed ended cable 21 in a second condition. A lock sleeve 24 selectively and slideably surrounds the lock 23.

Referring to FIG. 2 and again to FIG. 3, each bracelet 20 further comprises a bracelet housing 25.

Referring again to FIGS. 3 and 6, the bracelet housing 25 further comprises a plurality of communicating bracelet electronic components. The communicating bracelet electronic components comprise a first speaker 26, an audio alarm 27, a battery pack 28, and a first CPU 29. The first CPU 29 and the battery pack 28 are in communication with the electronic lock 23. The bracelet housing 25 further comprises a GPS 30, a USB port 31, and a first transceiver 32.

Figure 1:
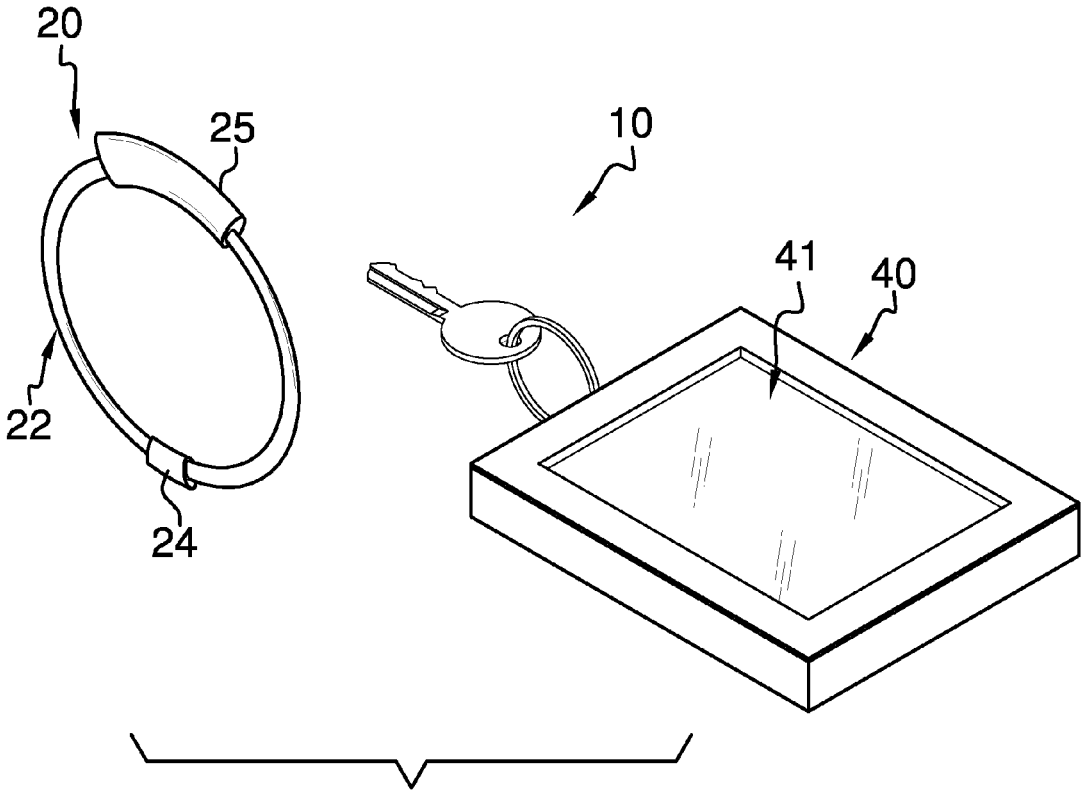
FIG. 1 is a perspective view.
Figure 2:
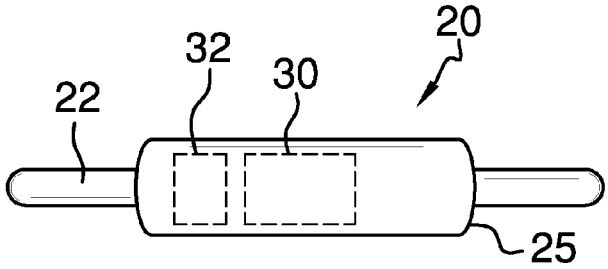
FIG. 2 is a top plan view of the bracelet.

Referring to FIG. 1, a caregiver monitor 40 is provided. The caregiver monitor 40 is in wireless communication with each bracelet 20.

Figure 6:
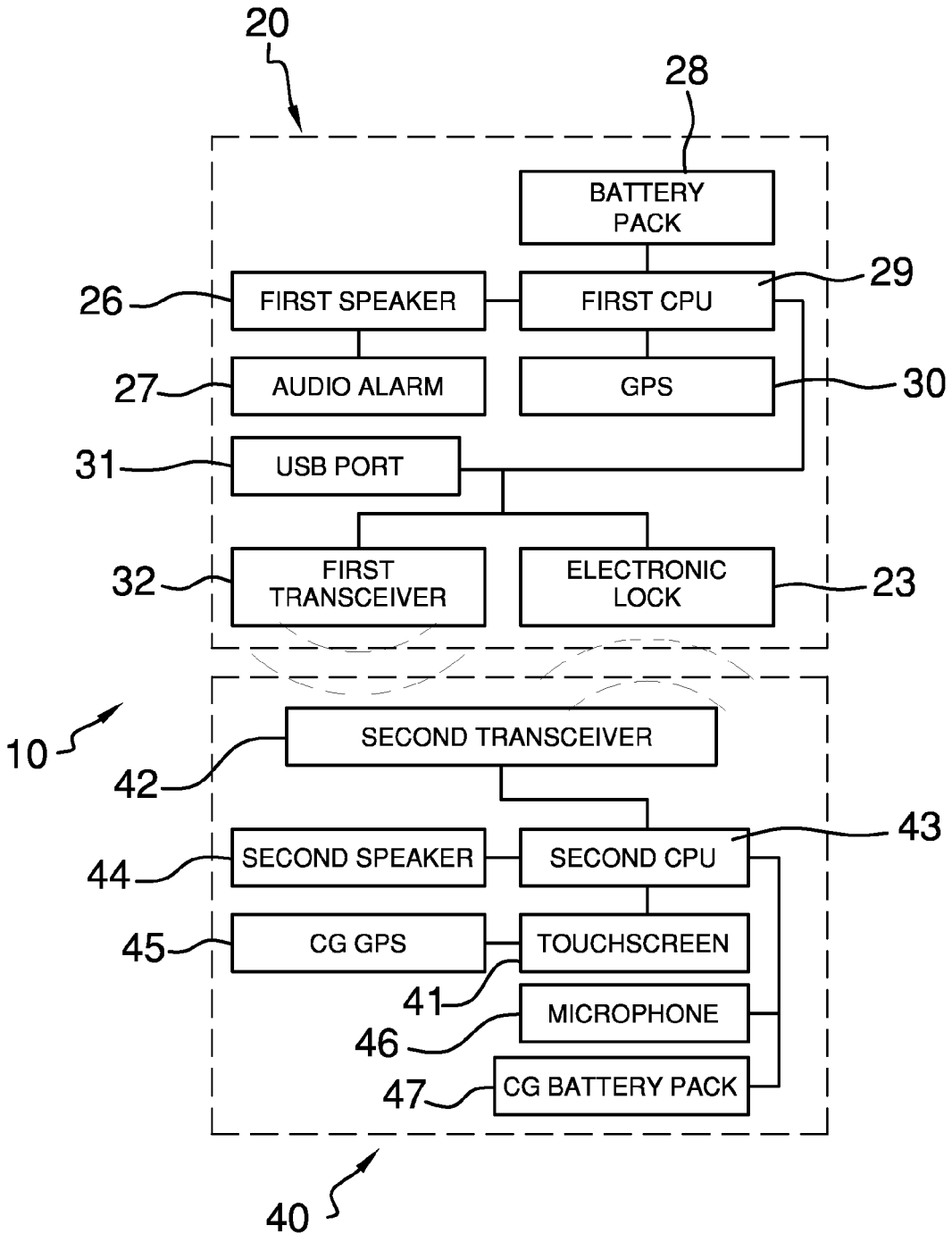
FIG. 6 is a schematic block diagram of electronic components of the bracelet and the caregiver monitor.

Referring to FIG. 5 and again to FIG. 6, the caregiver monitor 40 comprises a plurality of communicating monitor electronic components. The monitor electronic components further comprise a touchscreen 41. The touchscreen 41 is configured to establish and accept fingerprint recognition of a plurality of approved users. Therefore, an unapproved user is not allowed access to the caregiver monitor 40 and thereby in turn to each of the bracelets 20. The caregiver monitor 40 also comprises a second transceiver 42 whereby the second transceiver 42 and the first transceiver 32 of each bracelet 20 communicate. A second CPU 43 is provided within the caregiver monitor 40, as is a second speaker 44. The caregiver monitor 40 further comprises a CG GPS 45 that communicates with each bracelet 20 GPS 30. A microphone 46 is provided within the caregiver monitor 40 so that a caregiver can verbally transmit to each bracelet 20 and thereby be heard over bracelet 20 first speakers 26. A CG battery pack 47 powers the caregiver monitor 40. A key ring loop 49 is provided on the caregiver monitor 40 for convenience.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the child monitor device may be used.

What is claimed is:

1. A child monitor device comprising, in combination:

a plurality of bracelets, each bracelet comprising:

a cable;

a soft cover surrounding the cable;

a lock configured to provide an open ended cable in a first condition and a closed ended cable in a second condition;

a lock sleeve selectively and slideably surrounding the lock;

a bracelet housing, the bracelet housing further comprising a plurality of communicating bracelet electronic components, the communicating bracelet electronic components comprising:

a first speaker;

an audio alarm;

a battery pack;

a first CPU, the first CPU and the battery pack in communication with the lock;

a GPS;

a USB port;

a first transceiver;

a caregiver monitor, the caregiver monitor in wireless communication with each bracelet, the caregiver monitor comprising a plurality of communicating monitor electronic components, the monitor electronic components further comprising:

a touchscreen, the touchscreen configured to establish and accept fingerprint recognition of a plurality of approved users;

a second transceiver;

a second CPU;

a second speaker;

a GPS in communication with each bracelet GPS;

a microphone;

a battery pack.

2. The device according to claim 1 wherein each bracelet is further flexible.

3. The device according to claim 2 wherein each bracelet lock further comprises an electronic lock.

4. The device according to claim 3 wherein each caregiver monitor further comprises an exterior key ring loop.

5. The device according to claim 4 wherein the touchscreen, the second CPU of the caregiver monitor and the first CPU of each bracelet monitor are further configured to accept a plurality of user instructions of alarm distances between the caregiver monitor and the bracelets.

6. The device according to claim 3 wherein the touchscreen, the second CPU of the caregiver monitor and the first CPU of each bracelet monitor are further configured to accept a plurality of user instructions of alarm distances between the caregiver monitor and the bracelets.

7. The device according to claim 2 wherein each caregiver monitor further comprises an exterior key ring loop.

8. The device according to claim 7 wherein the touchscreen, the second CPU of the caregiver monitor and the first CPU of each bracelet monitor are further configured to accept a plurality of user instructions of alarm distances between the caregiver monitor and the bracelets.

9. The device according to claim 2 wherein the touchscreen, the second CPU of the caregiver monitor and the first CPU of each bracelet monitor are further configured to accept a plurality of user instructions of alarm distances between the caregiver monitor and the bracelets.

10. The device according to claim 1 wherein each bracelet lock further comprises an electronic lock.

11. The device according to claim 10 wherein each caregiver monitor further comprises an exterior key ring loop.

12. The device according to claim 11 wherein the touchscreen, the second CPU of the caregiver monitor and the first CPU of each bracelet monitor are further configured to accept a plurality of user instructions of alarm distances between the caregiver monitor and the bracelets.

13. The device according to claim 10 wherein the touchscreen, the second CPU of the caregiver monitor and the first CPU of each bracelet monitor are further configured to accept a plurality of user instructions of alarm distances between the caregiver monitor and the bracelets.

14. The device according to claim 1 wherein each caregiver monitor further comprises an exterior key ring loop.

15. The device according to claim 14 wherein the touchscreen, the second CPU of the caregiver monitor and the first CPU of each bracelet monitor are further configured to accept a plurality of user instructions of alarm distances between the caregiver monitor and the bracelets.

16. The device according to claim 1 wherein the touch-screen, the second CPU of the caregiver monitor and the first CPU of each bracelet monitor are further configured to accept a plurality of user instructions of alarm distances between the caregiver monitor and the bracelets.

* * * * *